US006704981B2

(12) United States Patent
Strickland et al.

(10) Patent No.: US 6,704,981 B2
(45) Date of Patent: Mar. 16, 2004

(54) SUPERPLASTIC FORMING METHOD

(75) Inventors: George Strickland, Preston (GB); Adam B Marriott, Oswaldtwistle (GB)

(73) Assignee: BAE Systems plc, Farnborough (GB)

( * ) Notice: Subject to any disclaimer, the term of this patent is extended or adjusted under 35 U.S.C. 154(b) by 0 days.

(21) Appl. No.: 10/221,037

(22) PCT Filed: Mar. 2, 2001

(86) PCT No.: PCT/GB01/00918

§ 371 (c)(1),
(2), (4) Date: Sep. 9, 2002

(87) PCT Pub. No.: WO01/70428

PCT Pub. Date: Sep. 27, 2001

(65) Prior Publication Data

US 2003/0091853 A1 May 15, 2003

(30) Foreign Application Priority Data

Mar. 20, 2000 (GB) ..... 006734

(51) Int. Cl.[7] ..... B21D 31/04; B23K 26/00; B23K 20/00; B23K 28/00

(52) U.S. Cl. ..... 29/6.1; 29/17.4; 29/527.1; 228/141.1; 228/193; 228/157; 148/564; 148/559

(58) Field of Search ..... 148/564, 559; 72/709; 420/902; 228/262.21, 141.1, 193, 228, 157, 227, 155; 29/17.4, 18.1, 454, 527.1, 6.1; 156/79

(56) References Cited

U.S. PATENT DOCUMENTS

| | | | | |
|---|---|---|---|---|
| 4,304,821 | A | 12/1981 | Hayase et al. | 428/593 |
| 5,143,276 | A | 9/1992 | Mansbridge et al. | 228/157 |
| 5,868,023 | A | 2/1999 | Wehner et al. | 72/60 |
| 5,994,666 | A | 11/1999 | Buldhaupt et al. | 219/121.64 |
| 6,419,146 | B1 * | 7/2002 | Buldhaupt et al. | 228/193 |

FOREIGN PATENT DOCUMENTS

| | | | |
|---|---|---|---|
| EP | 0703019 | A1 | 3/1996 |
| GB | 2129340 | A | 5/1984 |
| GB | 1 495 655 | A | 12/1997 |
| WO | 97/27045 | * | 7/1997 |

* cited by examiner

*Primary Examiner*—Michael LaVilla
(74) *Attorney, Agent, or Firm*—Nixon & Vanderhye P.C.

(57) ABSTRACT

A method of forming sheets of superplastically formable material into a three dimensional article, the sheets being joined together along diffusion bonds to form discrete cells, at least one gas path being provided through the bond between cells. The sheets are heated to a temperature at which they exhibit superplastic properties and a gas injected between the sheets to expand the cells, the gas paths allowing the injected gas to pass from cell to cell. The edges of the gas paths are locally heated to change the microstructure of the sheets in the edge areas, which reduces the flow resistance of the edges under superplastic forming conditions and thereby reduces the propensity of the diffusion bonds bordering the gas transfer holes to peel apart under the forces of the inert gas exerted on the sheets at the gas transfer paths.

4 Claims, 2 Drawing Sheets

SUPERPLASTIC FORMING METHOD

This application is the US national phase of International Application No. PCT/GB01/00918, filed Mar. 2, 2001, which designated the U.S., the entire content of which is hereby incorporated by reference.

TECHNICAL FIELD

The present invention relates to superplastic forming (SPF) in conjunction with diffusion bonding (DB/SPF) and to an article, e.g. a panel, made thereby.

BACKGROUND ART

Combined diffusion bonding and superplastic forming is an established technique for making composite articles from materials that exhibit superplastic properties at elevated temperatures. The materials of interest are primarily titanium and aluminium alloys, but may include other metals exhibiting superplastic properties. In established DB/SPF processes, for example see U.S. Pat. No. 5,143,276, U.S. Pat. No. 4,534,503, GB-2 030 480, GB-2 129 340, U.S. Pat. No. 4,607,783, U.S. Pat. No. 4,351,470, U.S. Pat. No. 4,304,821 and EP-0 502 620, it is known to apply stop-off material to selected areas of two or more sheets of superplastic material; several sheets, including the sheets to which stop-off material has been applied, are then assembled into a pack with the stop-off material lying between adjacent superplastic sheets. The assembled pack is then heated and compressed until the sheets are diffusion bonded together; however, the sheets are not bonded in the selected areas covered by stop-off material since the stop-off material prevents diffusion bonding in those areas. The superplastic forming step is then conducted by heating the bonded pack, usually in a mould, to a temperature at which the components exhibit superplastic properties. An inert gas is then injected in a controlled manner into the unbonded areas of the pack under high pressure so as to "inflate" the sheets gradually into a three dimensional structure having an outer shape corresponding to the shape of the mould. Because the sheets are superplastic, they stretch without necking or fracture and so can be formed into a variety of shapes.

The configuration of the final composite structure is dependent upon, among other things, the number of sheets in the pack, the location of the stop-off material and the shape of the mould. For example, it is known from GB-1495655 to form a composite panel from a pack comprising a pair of opposed face sheets and a core sheet sandwiched between, and bonded to, the face sheets; in the superplastic forming process, the face sheets are forced apart and because the internal core sheet is attached to both of the face sheets, the core sheet adopts a zigzag shape (often referred to as a "Warren Girder structure") that, in effect, constitutes struts extending from one face sheet to the other.

U.S. Pat. No. 4,304,821 and U.S. Pat. No. 5,143,276 each describes the making of a panel from four sheets of superplastic material from a pack comprising a pair of opposed face sheets and two core sheets sandwiched between the face sheets; the two core sheets are bonded to each other by linear welds. The face sheets are superplastically formed by injecting gas into the area between each face sheet and the adjacent core sheet to expand the face sheets into the shape of a mould; gas is then injected between the two core sheets. Because the core sheets are joined by the linear welds, the core sheets expand to form cells extending between the face sheets; the side walls of the cells are formed by U-shaped doubled-back sections of the two core sheets. This is often referred to as a "cellular structure".

GB-2 129 340 describes the making of a multi-cell panel by welding together two or more sheets of superplastic material by means of linear welds. Inert gas is injected into the region between the sheets to inflate them. Because the sheets are joined by the linear welds, the sheets expand to form the cells. In order to allow the inflating gas to reach the cells that are not directly adjacent to the gas injection site, gaps are left in the linear welds to allow the gas to pass from cell to cell and inflate the individual cells as it does so.

FIG. 1 shows a prior art pack for forming the core of a four-sheet panel. The core consists of two superimposed sheets 10 (only one is visible in FIG. 1) that are joined together along linear diffusion bonds 12 to form individual cells 14. A gas inlet 16 for supplying inflating gas is welded into the pack and communicates directly with the first cell 14*a*. Gaps 18 are left in the linear bonds to form gas transfer holes allowing the gas to pass from one cell to an adjacent cell 14*a*, 14*b*, . . . 14*h* to inflate the individual cells. A gas outlet 20 is also welded into the pack and communicates directly with the last cell 14*h*. Gas is fed into the pack through inlet 16 in accordance with a predefined pressure-time cycle that produces controlled strain on the pack. The forces on the sheets at the gas transfer holes sometimes cause the diffusion bond bordering the gas transfer holes to peel apart. This peeling has been minimised by the use of suitable pressure-time protocols but the problem has not been eliminated.

The present invention reduces the problem still further and can eliminate it altogether.

DISCLOSURE OF THE INVENTION

According to the present invention, there is provided a method of superplastically forming at least two sheets of superplastically formable material to form a three dimensional article, the sheets being joined together along diffusion bonds to form discrete cells and wherein a gas path is provided through the bonds between cells, the method comprising heating the sheets to a temperature at which they exhibit superplastic properties and injecting a gas between the sheets to expand the cells, the gas path allowing the injected gas to pass from cell to cell to expand the cells as it does so, and wherein the edges of the gas path as it passes through each diffusion bond have been locally heated to cause the metal at said edges to change microstructure, thereby increasing the flow resistance of the metal at the edges under superplastic forming conditions as compared with the rest of the sheets.

The change in microstructure increases the flow resistance of the metal at the edges under superplastic forming conditions and hence reduces the deformation at the edges and reduces the chance of the diffusion bonds peeling under superplastic conditions. The local heating may be achieved by spot welding, laser heat treatment, electron beam treatment or any other technique that can bring about controlled local heating. One advantage of using laser heat treatment is that it has numerical control capability and hence can readily be automated.

DESCRIPTION OF THE DRAWINGS

The invention will be further described, by way of example only, with reference to the accompanying drawings in which.

DETAILED DESCRIPTION OF THE PREFERRED EMBODIMENTS

Figure 1:
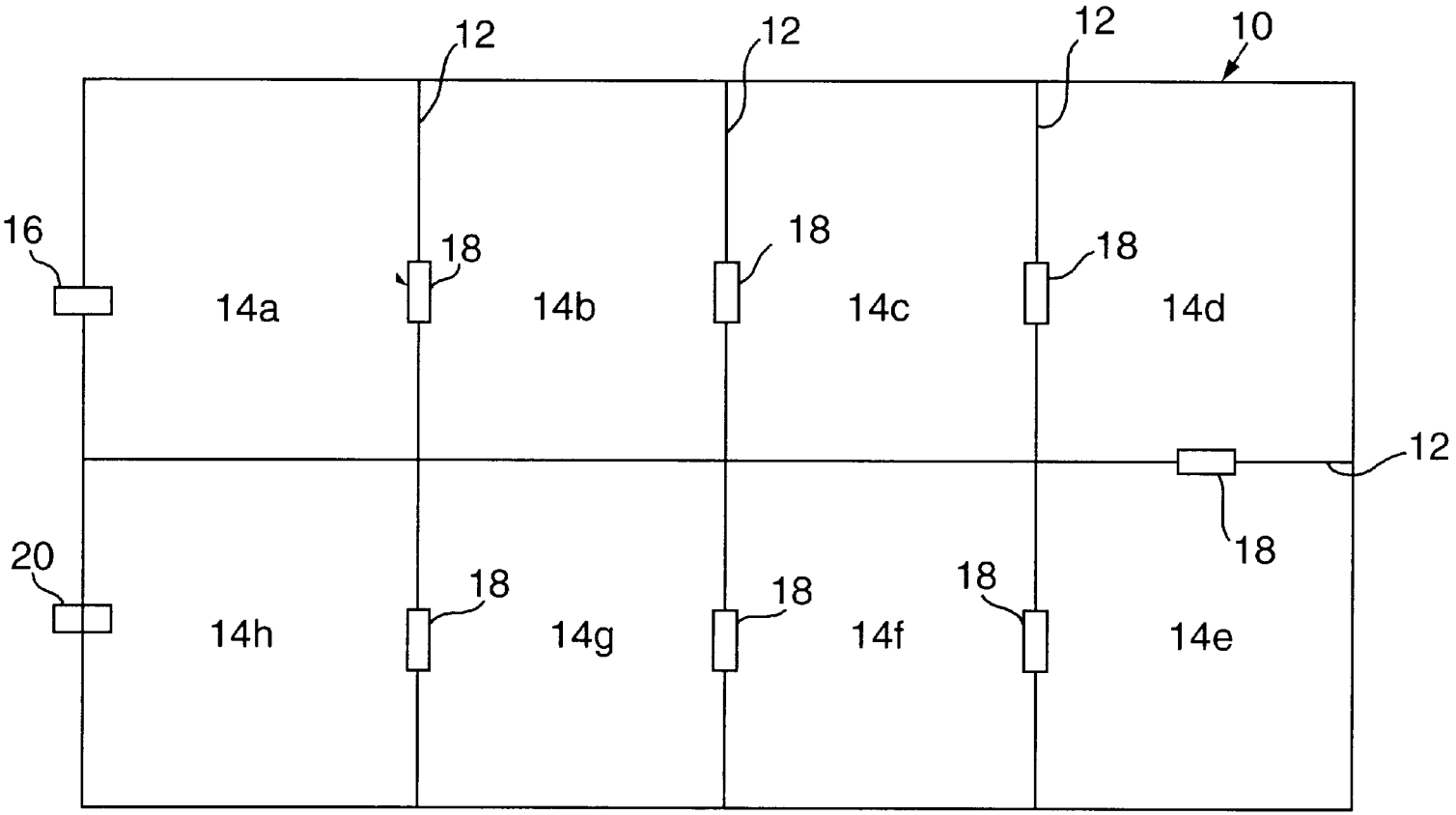
Fig.1. Prior Art
FIG. 1 shows the prior art arrangement of a pair of sheets that have been diffusion bonded together.

FIG. 1 has been described above in the prior art section.

Figure 2:
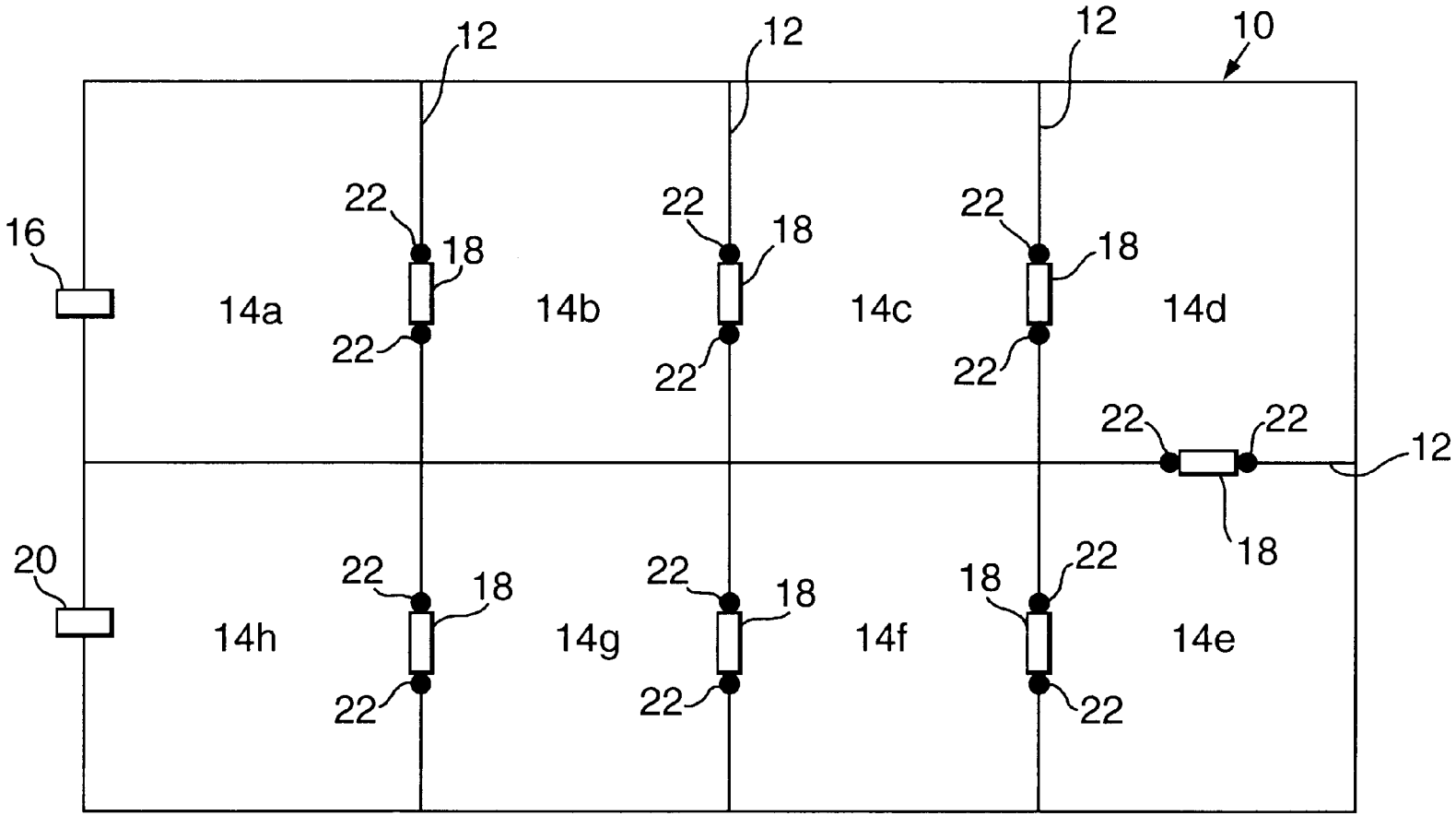
FIG. 2 shows an arrangement according to the present invention of a pair of sheets that have been diffusion bonded together.

The arrangement according to the present invention shown in FIG. 2 differs from the prior art arrangement shown in FIG. 2 in that, at the edges of the gas transfer holes, the sheets 10 have been heat treated in local areas 22 prior to superplastic forming, which has been found to eliminate or substantially reduce the problem of the diffusion bonds 12 peeling apart as a result of the stresses caused by the inert gas inflating the cells of the core sheets 10 under superplastic forming conditions. The local heat treatment may be brought about by spot welding or by laser heat treatment (which is preferably under NC (numerical control)) or by electron beam treatment or indeed by any other technique that can bring about controlled local heating.

Without being held to any particular theory, it is believed that the heat generated during the local heat treatment causes microstructural change in the superplastic metals, thereby decreasing the rate of flow of the metal in the heat treated region under superplastic forming conditions as compared with the rest of the sheets and the remaining parts of the diffusion bonds and thereby resisting the stress exerted on the edges of the gas transfer holes by the inflating gas.

What is claimed is:

1. A method of superplastically forming at least two sheets of superplastically formable material to form a three dimensional article, the sheets being joined together along diffusion bonds to form discrete cells and wherein a gas path is provided through the bonds between cells, the method comprising the steps of:

heating the sheets to a temperature at which they exhibit superplastic properties; and injecting a gas between the sheets to expand the cells, the gas path allowing the injected gas to pass from cell to cell to expand the cells as it does so, wherein prior to said injecting step, there is included the additional step of locally heating the edges of each gas path through a diffusion bond to cause the metal at said edges to change microstructure, thereby increasing the flow resistance of the metal at the edges under superplastic forming conditions.

2. A method as claimed in claim 1 wherein the local heating comprises spot welding the said edges.

3. A method as claimed in claim 1 wherein the local heating comprises laser heat treatment.

4. A method as claimed in claim 1 wherein the local heating comprises electron beam treatment.

* * * * *